United States Patent [19]

Hsu

[11] Patent Number: 4,905,555

[45] Date of Patent: Mar. 6, 1990

[54] BUILT-UP PUNCHER

[76] Inventor: Dragon Hsu, No. 1-1, Alley 1, Sec. 3, Pao-an St., Hsulin, Taipei Hsien, Taiwan

[21] Appl. No.: 335,402

[22] Filed: Apr. 10, 1989

[51] Int. Cl.[4] ..... B26F 1/02

[52] U.S. Cl. ..... 83/618; 83/620

[58] Field of Search ..... 83/620, 622, 167, 588, 83/464, 467 R, 452, 549, 605, 618

[56] References Cited

U.S. PATENT DOCUMENTS

| | | | |
|---|---|---|---|
| 678,577 | 7/1901 | Lukes | 83/588 |
| 2,717,643 | 9/1955 | Marano | 83/588 |
| 4,036,088 | 7/1977 | Ruskin | 83/167 |
| 4,611,520 | 9/1986 | Terracciano | 83/620 |
| 4,700,601 | 10/1987 | Simon | 83/622 |

*Primary Examiner*—Frank T. Yost
*Assistant Examiner*—Scott A. Smith
*Attorney, Agent, or Firm*—Lowe, Price, LeBlanc, Becker & Shur

[57] ABSTRACT

A built-up puncher comprises of a pressure plate, a stand body and a bottom block, wherein the stand body is having a plurality of fixed supports mounted thereon for setting therein of a plurality of eye-letting means respectively. The fixed supports each is having a front extension with an opening and two notches made thereon to match with the retaining slots of the pressure plate so as to make the mounting and dismounting of the pressure plate onto and from the stand body become easy.

1 Claim, 2 Drawing Sheets

BUILT-UP PUNCHER

BACKGROUND OF THE INVENTION

The present invention is related to a built-up puncher and, more particularly to a puncher which can be built up and dismounted easily by means of the locking effect between the retaining slots of a pressure plate and the front extensions of fixed supports which are mounted on a stand body.

While using a regular tri-hole puncher one may encounter some problems as hereunder: (1) Because the points of support are arranged at both lateral sides, apply force is not evenly distributed during punching and the middle eye-letting means does not completely punch through the papers; (2) Because the points of support are arranged at both lateral sides and the apply force is not evenly distributed during punching, the pressure plate tends to be deformed; (3) The mounting of the pressure with the stand body is rather complicated, therefore, the whole structure is difficult to assembly or to dismount; and (4) The eye-letting means are difficult to replace.

SUMMARY OF THE INVENTION

The present invention is to provide a built-up puncher which is comprised of a stand body, a pressure plate, and a bottom block; wherein the stand body is having a curved and stream-like surface for mounting thereon of a plurality of fixed supports, and comprising a plurality of round holes to communicate with a plurality of round holes made on said fixed supports. The said fixed supports each is having a front extension with an opening made thereon, and with two notches made at the inner side of the opening and the top of the front extension respectively.

The pressure plate is having a properly arranged curved surface comprising a plurality of retaining slots to match with the front extensions of said fixed supports. The bottom block is having a groove made at the middle part for easy mounting thereon of the stand body. The pressure plate may be easily mounted on the stand body by matching of the retaining slots with the front extensions or removed from the stand body by separating the retaining slots from the notches of the fixed supports.

DETAILED DESCRIPTION OF THE PREFERRED EMBODIMENTS

Figure 1:
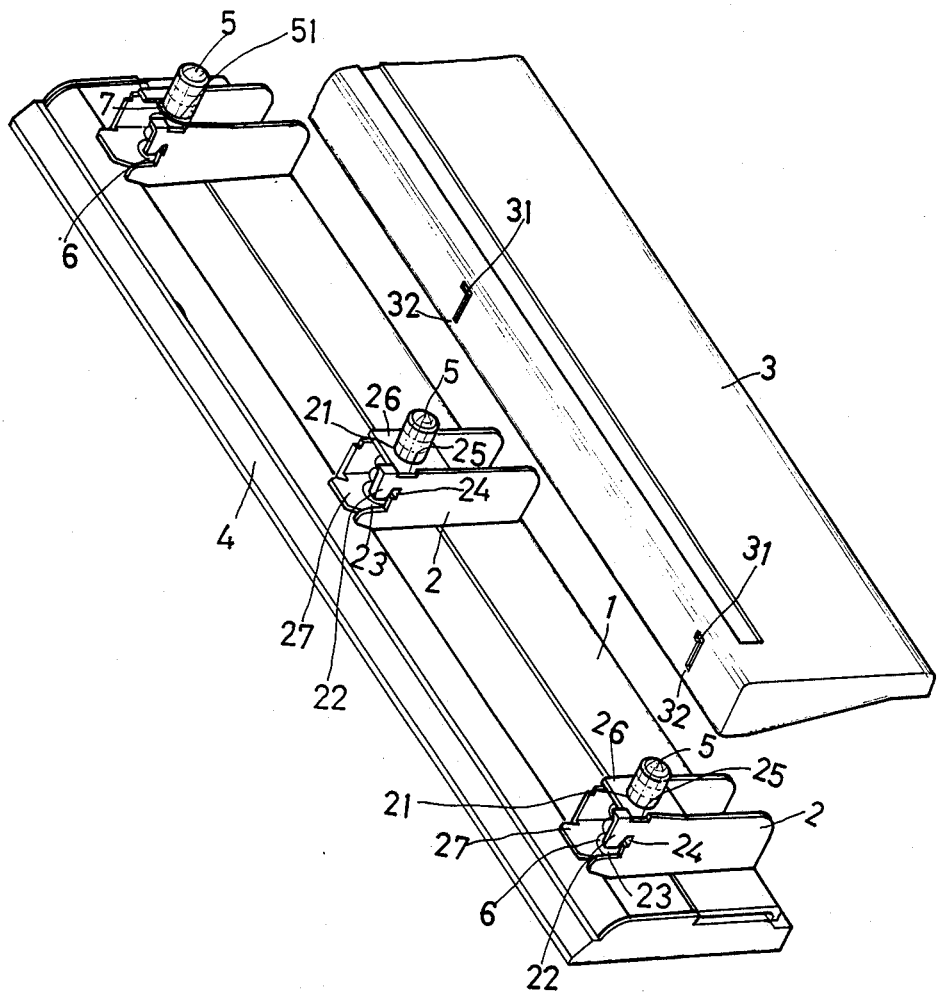
FIG. 1 is a perspective fragmentary view of the present invention.
Figure 2:
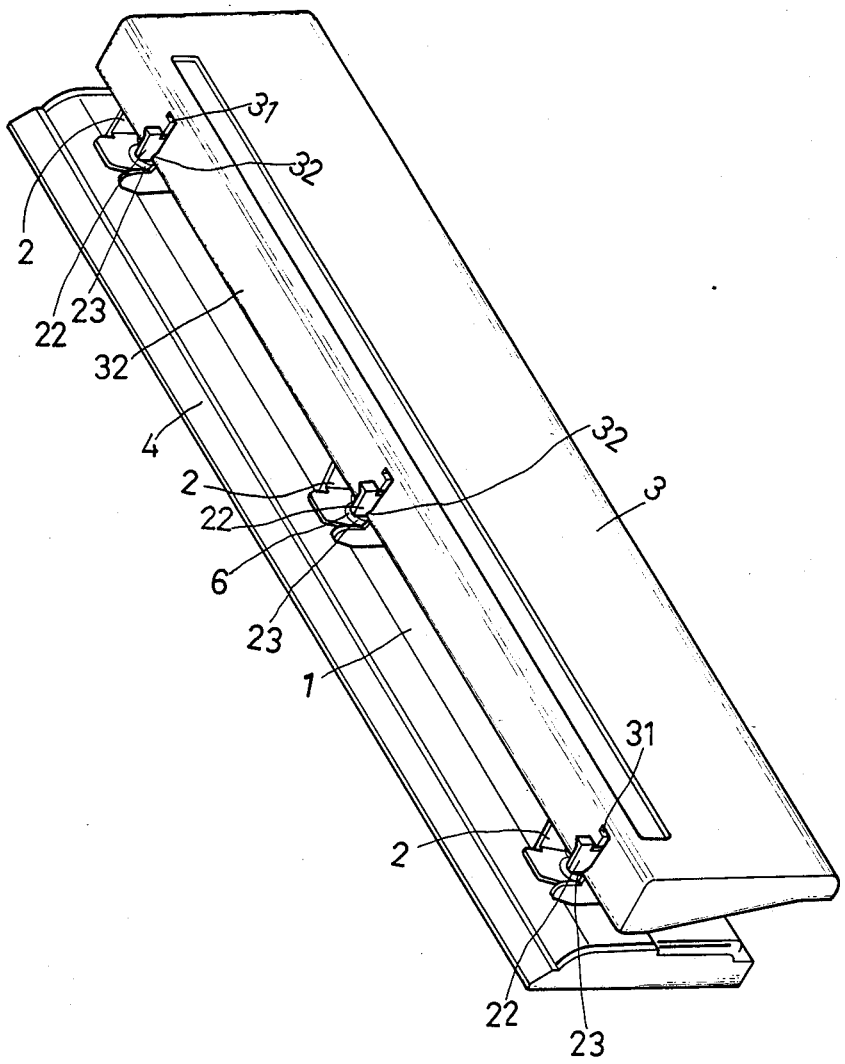
FIG. 2 is a perspective assembly view of the present invention.

Referring to FIGS. 1 and 2, a puncher is comprised of a stand body (1), a plurality of fixed supports (2), a pressure plate (3), a bottom block (4), a plurality of eye-letting means (5), a plurality of springs (6), and a plurality of retainer rings (7).

The stand body (1) has a curved and stream-like surface for mounting thereon of a plurality of fixed supports (2), and comprises a plurality of round holes (11) to communicate with the round holes (21) of the fixed supports (2) which are fixedly mounted on the stand body (1). The fixed supports (2) each is having a "⅂" shaped front extension (22), and opening (23) made below the front extension (22), and two notches (24) and (25) made at the inner side of the opening (23) and the top of the front extension (22) respectively and arranged in different size and shape to facilitate the operation of the pressing process of the pressure plate (3). The pressure plate (3) is having a properly arranged curved surface comprising a plurality of retaining slots (31) to match with the front extensions (22) of the fixed supports (2). The bottom block (4) is having a groove (not shown) made at the middle part for mounting thereon of the stand body (1). The eye-letting means (5) are arranged to match with the fixed supports (2) respectively and each is having a circular groove (51) and inserted in the round hole (21) of a matching fixed support (2) with a spring (6) and a retainer ring (7) mounted thereon. The springs (6) each is slipped on an associated eye-letting means (5) and set between the upper plane (26) and the lower plane (27) of an associated fixed support (2). The retainer rings (7) each is set in the inner side of the upper plane (26) of an associated fixed support (2) and mounted on the circular groove (51) of an associated eye-letting means (5) to let the associated eye-letting means (5) be movably set in the associated fixed support (2) and to protect the associated eye-letting means from breaking away.

When in assembly, each eye-letting means (5) is sleeved with a spring (6) and mounted with a retainer ring (7) so as to be movably retained in a fixed support (2).

When to mount the pressure plate (3) onto the stand body (1), the retaining slots (31) are firstly arranged to aim at the front extensions (22) of the fixed supports (2) respectively and then, the front extensions (22) of the fixed supports (2) are arranged to insert through the retaining slots (31) to let the planes (32) between the retaining slots (31) and the pressure plate (3) be positioned at the notches (24) of the fixed supports (2) respectively. When the pressure plate (3) is pressing down, the eye-letting means (5) will be simultaneously pushed downward to punch papers set therebelow. Because of the special design of the notches (24), the pressure plate (3) is forced to move along the angle of the notches (24) smoothly when it is pressed down. When a pressing force is released from the pressure plate, the springs (6) will push the eye-letting means (5) return back to their original position.

When to dismount the assembly for replacement of the eye-letting means (5), press down the pressure plate (3) to let the planes (32) of the pressure plate (3) break away from the restraint of the notches (24), and push the pressure plate (3) outward to let the retaining slots (31) be separated from the front extensions (22) of the fixed supports (2). Thus, the pressure plate (3) is removed from the stand body (1), and the eye-letting means (5) can be removed easily after the associated retainer rings (7) are taken away.

I claim:

1. A built-up puncher comprised of a stand body, a pressure plate, and a bottom block; wherein said stand body is having a curved and streamlined surface for mounting thereon of a plurality of fixed supports, said stand body further comprising a plurality of round holes to communicate with a plurality of round holes made on said fixed supports, said fixed supports each having a generally L-shaped front extension with an opening made thereon and a notch made at both an inner side of said opening and a top portion of said fixed support adjacent said generally L-shaped front extension respectively to facilitate the operation of the pressing process of said pressure plate; said pressure plate having a properly arranged curved surface comprising a plurality of generally L-shaped retaining slots to match with the generally L-shaped front extensions of said fixed supports; and wherein said pressure plate is mounted on said stand body by aiming said generally L-shaped retaining slots of said pressure plate at said generally L-shaped front extensions of said fixed supports to let said generally L-shaped retaining slots be respectively retained by said notches of each of said fixed supports; and wherein said pressure plate is removed from said stand body by separating said generally L-shaped retaining slots of said pressure plate from said notches of said fixed supports.

* * * * *